United States Patent [19]

Harkus

[11] Patent Number: 4,915,299

[45] Date of Patent: Apr. 10, 1990

[54] FASTENING RAILWAY RAILS

[75] Inventor: Lance Harkus, Carlingford, Australia

[73] Assignee: Pandrol Limited, London, United Kingdom

[21] Appl. No.: 260,176

[22] Filed: Oct. 19, 1988

[30] Foreign Application Priority Data

Oct. 19, 1987 [AU] Australia ..... 79914/87

[51] Int. Cl.[4] ..... F01B 9/28

[52] U.S. Cl. ..... 238/351; 238/349

[58] Field of Search ..... 238/310, 299, 315, 338, 238/343, 349, 351, 344, 345, 352, 353, 283, 265, 377, 378; 24/546, 547, 67.9, 563

[56] References Cited

U.S. PATENT DOCUMENTS

| | | | |
|---|---|---|---|
| 675,761 | 6/1901 | Vaaler | 24/546 |
| 4,627,132 | 12/1986 | Markham | 24/546 |
| 4,757,945 | 7/1988 | Leeves | 238/107 |

FOREIGN PATENT DOCUMENTS

| | | |
|---|---|---|
| 0232029 | 8/1987 | European Pat. Off. . |
| 1658300 | 4/1971 | Fed. Rep. of Germany . |
| 2310168 | 12/1976 | France . |
| 2330803 | 6/1977 | France . |
| 1059190 | 2/1967 | United Kingdom . |
| 1497908 | 1/1978 | United Kingdom . |
| 1510224 | 5/1978 | United Kingdom . |
| 2034788 | 6/1980 | United Kingdom . |

*Primary Examiner*—Andres Kashnikow
*Assistant Examiner*—Mark T. Le
*Attorney, Agent, or Firm*—Norbert P. Holler

[57] ABSTRACT

A railway rail-fastening clip, made by bending an initially straight rod, is approximately in the form of a letter e. The axies of all parts of the clip, except possibly the free end of the lower arm of the e, lie in a single plane. The rod may have a length less than 15 times the thickness of the rod. A retaining arrangement for the clip may have an opening in which lie the center arm and the upper arm of the e, the lower arm of the e pressing downwardly on the flange at the bottom of a railway rail. The opening may be in an electrically insulating bushing in a clip-retainer made of metal.

13 Claims, 10 Drawing Sheets

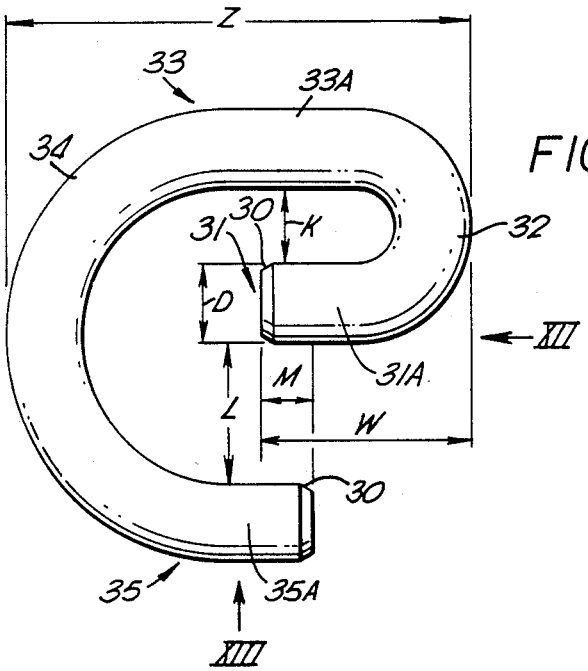
FIG. 11
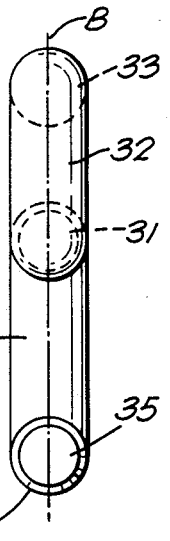
FIG. 12
FIG. 13
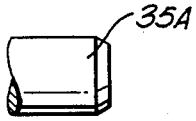
FIG. 14
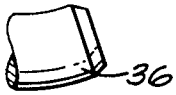

FASTENING RAILWAY RAILS

FIELD OF THE INVENTION

This invention relates to a clip which is suitable for fastening a railway rail and to a railway rail-and-fastening assembly including the clip.

THE MOST RELEVANT PRIOR ART AND ITS DISADVANTAGES

FIGS. 1 and 2 of the accompanying drawings show such a clip which has been widely known since about 1976 and has been patented in numerous countries. It is made by bending an initially straight steel rod, of circular cross-section, so that it has three arms 1, 3 and 5 connected together by reverse bends 2 and 4, the shape being such that when arm 1, which is straight, is horizontal and the lowest parts of the arms 3 and 5 lie in the same horizontal plane X and the clip is viewed from one end (FIG. 1), the angle G between the reverse bend 2 and a plane Y, which is parallel to the plane X and contains the lowest part of the arm 1, is less than 45°, for example about 10°. This is in contrast to a previously known clip of somewhat similar shape in which the corresponding angle was about 69° according to the drawings in some patent specifications but usually more than 80° in practice. When the clip is in the orientation shown in FIG. 1 and it is viewed from above (FIG. 2), the clip looks like a letter e and in consequence the clip has become widely known as an e-clip, whereas the previously known clip is known as a P-R clip. An e-clip is essentially made from a rod having a length less than eighteen times its thickness, whereas a P-R clip was usually made from a rod having a length at least 24 times its thickness. The numerous patent specifications relating to the e-clip suggest that the ratio between length and thickness of the rod may be less than 15 but in practice the ratio has usually been about 17.

FIG. 3 shows an e-clip according to FIGS. and 2 with its center arm 1 driven, in a direction parallel to the length of a rail having a flange 6 at its base, into a hole through the upper part 7 of a cast metal retaining member having a lower part 8 which is embedded in a concrete railway sleeper 9 (the term "railway sleeper" is used herein to mean what is often called a "rail tie"), the arm 3 of the clip bearing downwardly on a ledge 10 on the retaining member and the arm 5, which has a flat surface 5A at its bottom, bearing downwardly on the flange 6 through an insulator 11. This insulator and a pad 12 beneath the flange 6 of the rail electrically insulate the rail from the sleeper, which is essential if the rail is to be used to carry electric currents for signaling. The clip reaches the position illustrated in FIG. 3 by driving it in the direction towards the viewer. Sometimes it is impossible to drive the clip in that direction, for example due to the presence of obstructions such as plates joining two lengths of rail together. It is possible to drive the same clip in the opposite direction but then the arm 3 of the clip, instead of the arm 5, will bear downwardly on the insulator 11 and the area of contact between the clip and the insulator will be further to the left, considering FIG. 3, and lower because the upper surfaces of the flange 6 and the insulator 11 are inclined to the horizontal, with the result that less downward force is exerted on the rail. If it is required to drive a clip in the direction away from the viewer and still have the arm 5 of the clip bearing on the rail, it is necessary to use the modified clip shown in FIGS. 4 and 5, which is also called an e-clip but in fact is like a mirror-image of a letter e.

The e-clip has the advantage, over the P-R clip, that it is made from a shorter rod, and is therefore lighter and less costly, and it exerts a greater downward force on the flange 6 of the rail, without being so highly stressed that the number of clips which break is unacceptable. However, the provision of two basic kinds of clip, the one shown in FIGS. 1 and 2 and the one shown in FIGS. 4 and 5, is a major disadvantage of both the P-R clip and the e-clip. Also, neither type of clip is convenient when it is desired to install clips by automatic machinery comprising an upright tubular feeder containing a stack of clips and means for taking always the lowest clip in the stack and driving it into one of the retaining members, whereupon all the other clips in the stack descend in the feeder, because the clips are not shaped so as to form a neat stack in which all the clips retain the same orientation.

The usual method of making the P-R clip and the e-clip is, in a first stage, to bend an initially straight rod until it has the shape shown in FIGS. 6 and 7 (in which, FIG. 7 shows a view taken as indicated by the arrow VII in FIG. 6), the axis of the rod in the parts 1, 2 and 3 lying in one plane R and the axis of the rod in the parts 3, 4 and 5 lying in another plane T inclined to the plane R, and then, in a second stage, to shape the rod further to provide the final shape shown in FIGS. 1 and 2 or FIGS. 4 and 5. The necessity for this second stage adds to the cost of production of the clip and the additional engagement of the rod by the shaping tools weakens the rod.

OBJECT OF THE INVENTION

It is an object of the present invention to overcome at least the second of the above-mentioned disadvantages of the e-clip.

OUTLINE OF THE INVENTION

According to a first aspect of the present invention, there is provided a clip which is suitable for fastening a railway rail, the clip having been made by bending an initially straight rod approximately to the shape of a letter e having an upper arm, a center arm and a lower arm, the axes of all parts of the clip, except possibly the free end of the lower arm of the e, lying in a single plane.

Most clips according to the first aspect of the invention will be made from rods at least 8 mm. thick and in most cases the cross-section of the rod will be circular but, in principle, cross-sections other than circular, for example square or hexagonal, could be used and for light or narrow-gauge railways thinner rods may be suitable.

Preferably, the rod when straight had a length less than 18 times, and better still less than 15 times, the thickness of the rod, i.e. the diameter of the rod if the rod is of circular cross-section, and preferably the clip has a first straight portion in the center arm of the e, a second straight portion in the upper arm of the e and a third straight portion in the lower arm of the e, these straight portions being parallel to one another and the shortest distance between the first and second straight portions being less than the shortest distance between the first and third straight portions.

Preferably, in contrast to the e-clip, the overlap between the center arm and the lower arm of the e is less than the thickness of the rod, so as to reduce still further the required length of the rod.

According to a second aspect of the invention, there is provided an assembly comprising a foundation for a railway rail, a rail having at its base a flange standing on the foundation, a clip-retaining arrangement having an opening above the foundation beside the rail flange and a substantially e-shaped clip according to the first aspect of the invention having both the center arm and the upper arm of the e in said opening in the clip-retaining arrangement and substantially parallel to the rail, the lower arm of the e bearing downwardly on the upper surface of the rail flange.

The retaining arrangement preferably includes a metallic part which at least partially defines an opening and a bushing of electrically insulating material in that opening, the clip having its center arm and its upper arm within the bushing.

The foundation could be a wooden, steel or concrete railway sleeper or a block of concrete or a long slab of concrete extending along the railway track. If it is a concrete railway sleeper and if the bushing is provided, preferably the metallic part of the clip-retaining arrangement has a tail portion which has been incorporated in the sleeper during casting of the concrete and the sleeper has a recess in its upper surface, which recess has been formed by the presence of the bushing during the casting operation.

FURTHER PRIOR ART

Flat clips made by bending steel rods of circular cross-section so that the axis of the entire rod remains in a single plane have been proposed previously. An example is shown in FIGS. 8 and 9, of which FIG. 8 shows a plan view and FIG. 9 shows a cross-sectional view taken as indicated by the arrows IX. However, the intention was that only the arm 13 should lie in a passageway, parallel to the rail, in a retaining arrangement for the clip, either the arm 14 or the arms 15 and 16 projecting over the flange of the rail. Of course, the clip is made from a very long rod and is uneconomical. Another known arrangement is shown in FIG. 10. The somewhat S-shaped clip 17 is flat before it is installed in the assembly, in which two arms 18 and 19 of the clip are held in recesses in a block 20 and the third arm 21 bears downwardly on the flange 22 of a rail via an electrical insulator 23.

INTRODUCTION TO THE DRAWINGS

Apart from the prior art structures, discussed above with reference to FIGS. 1 to 10 of the accompanying drawings, two clips in accordance with the first aspect of the invention and an assembly in accordance with the second aspect of the invention are described below with reference to FIGS. 11 to 20 of the accompanying drawings, in which:

FIG. 11 shows a plan view of a first clip,

FIG. 12 shows an end view of the same clip, taken as indicated by the arrow XII in FIG. 11, FIG. 13 shows a side view of part of the same clip, taken as indicated by the arrow XIII in FIG. 11, FIG. 14 shows, by means of a view corresponding to FIG. 13, part of a second clip which differs from the first clip only as shown, FIG. 15 shows a side view of a retaining member, FIG. 16 shows a flat blank from which the retaining member of FIG. 15 was made, FIG. 17 shows an end view of a railway rail and means on its left side for supporting it and holding it down, FIG. 18 shows a plan view of the parts shown in FIG. 17, FIG. 19 shows to a larger scale an end view of part of the same rail and means on its right side for supporting it and holding it down, and FIG. 20 shows a plan view of the parts shown in FIG. 19 but with parts of the rail removed to reveal a pad underneath the rail.

DETAILED DESCRIPTION OF THE PARTS SHOWN IN THE DRAWINGS

Figure 1:
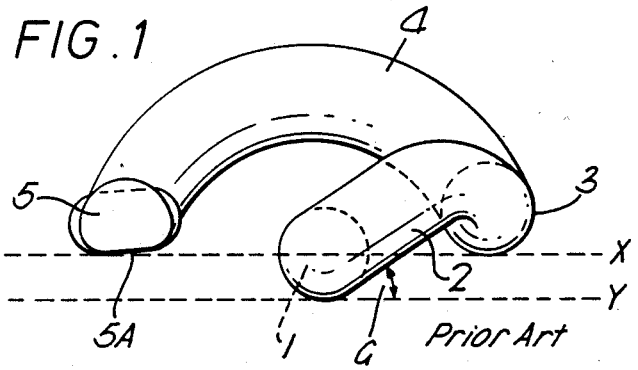
Figure 10:
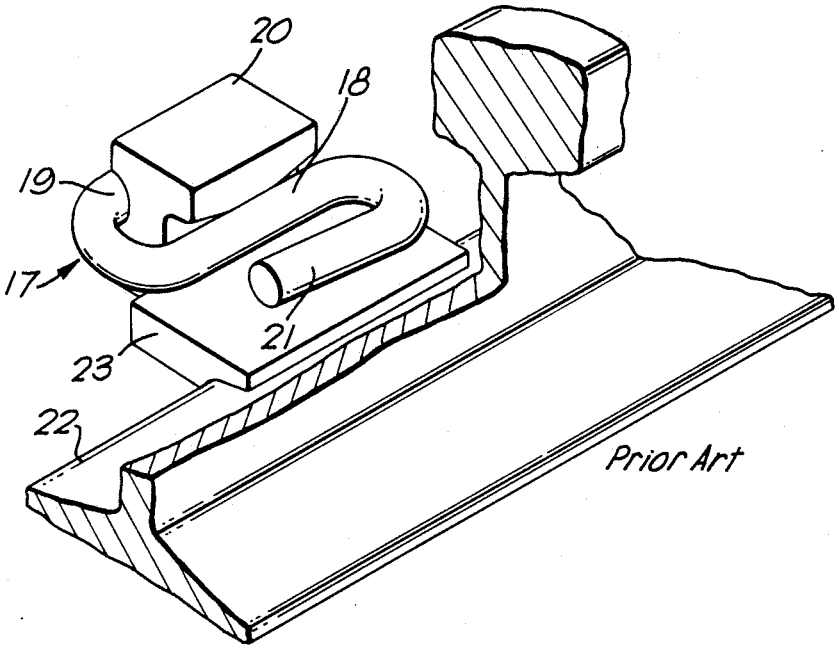
Figure 2:
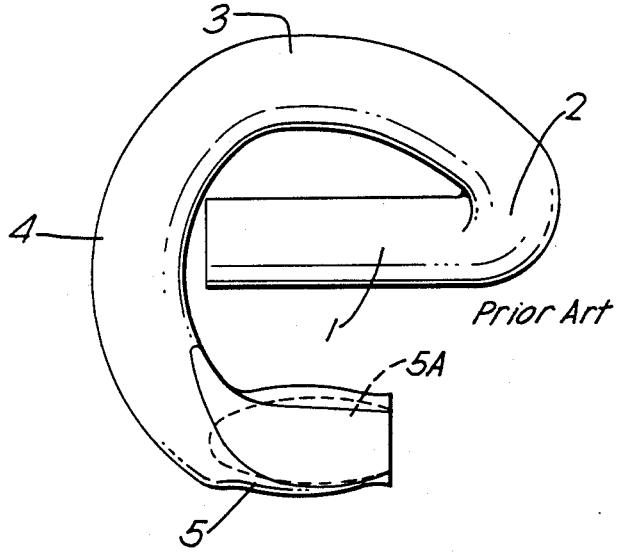
Figure 5:
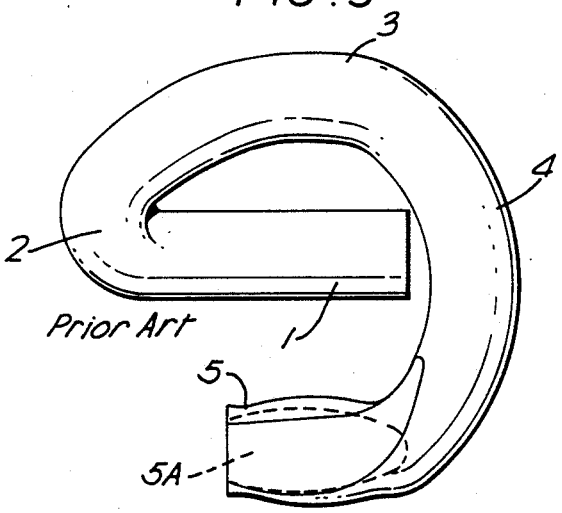
Figure 3:
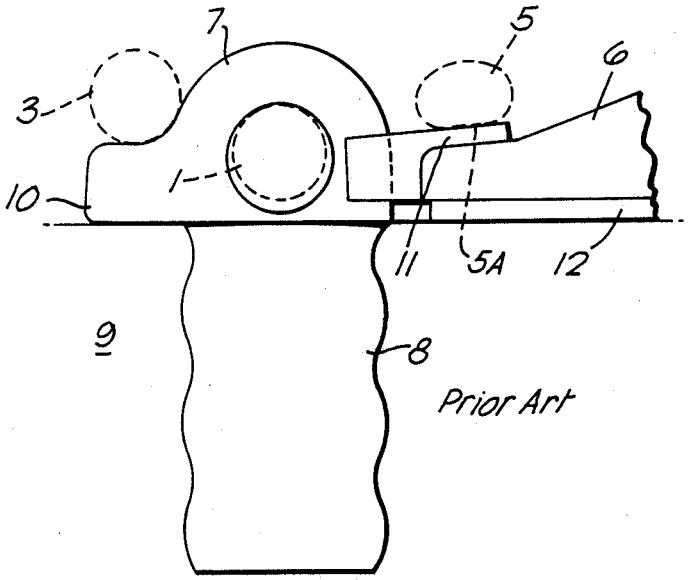
Figure 4:
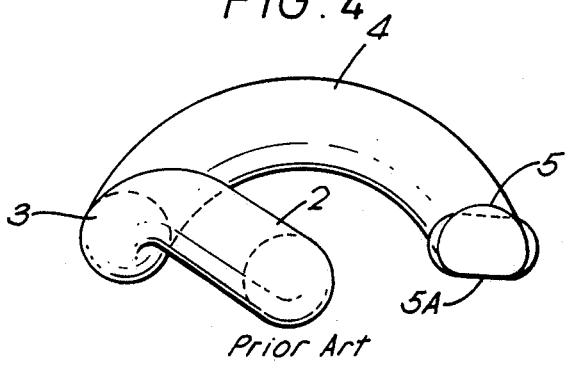
Figure 7:
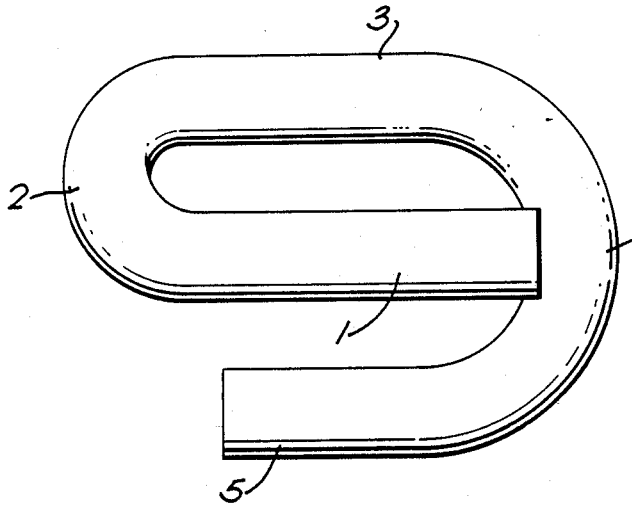
FIG. 7 Prior Art
Figure 6:
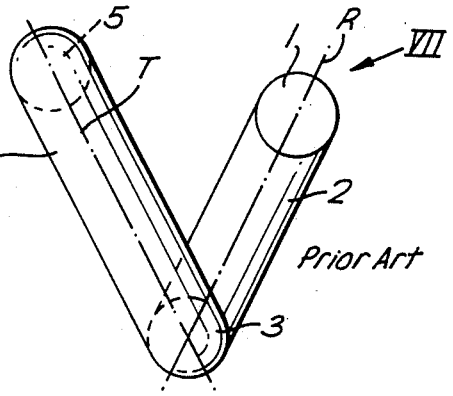
FIG. 6 Prior Art
Figure 8:
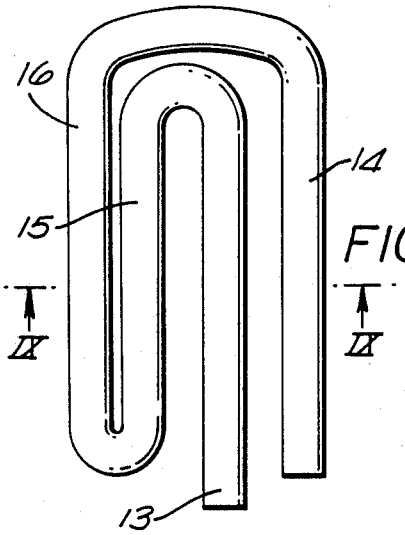
Figure 9:
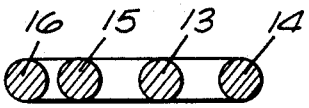
FIG. 9 Prior Art

The clip shown in FIGS. 11 to 13 is made by bending an initially straight rod of spring steel, of circular cross-section, having a length of 260 mm. and a diameter of 18 mm. (ratio length: diameter =14.44) which has previously been formed at each end with a chamfer 30 extending around its entire periphery. The bending of the rod takes place in a single operation and results in the clip being approximately in the shape of a letter e having a center arm 31 joined by a reverse bend 32 to an upper arm 33 which is joined by another reverse bend 34 to a lower arm 35. The three arms 31, 33 and 35 have portions 31A, 33A and 35A, respectively, which are straight and parallel to one another, the shortest distance K between portions 31A and 33A being less than one and a half times the diameter D of the rod and also less than one and a quarter times that diameter and in fact about equal to that diameter, whereas the shortest distance L between the portions 31A and 35A is about twice the diameter D. The portions 31A and 35A have an overlap of M which is less than the diameter D and is even less than three quarters of the diameter D. The distance W between the right-hand end of the clip and the left-hand end of the arm 31 is less than half the overall length Z of the clip. The dimensions M, W and Z are measured along lines parallel to the lengths of the straight portions 31A, 33A and 35A of the clip.

When the clip is free from stress, i.e., before it is incorporated in an assembly on a railway track, for example according to FIGS. 17 and 18 or FIGS. 19 and 20, the axis of the rod, over the entire length of the bent rod, lies in a plane B shown in FIG. 12. Instead, the arm 35 could be slightly up-turned as shown at 36 in FIG. 14 in order to make it easier to move the arm 35 along the rail. The chamfering 30 at the free end of the arm 35 serves the same purpose. The chamfering of the free end of the arm 31 facilitates withdrawal of the clip from a bushing, which is described below.

Figure 15:
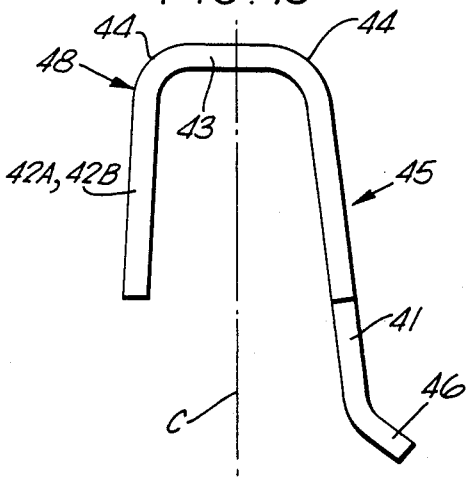
Figure 16:
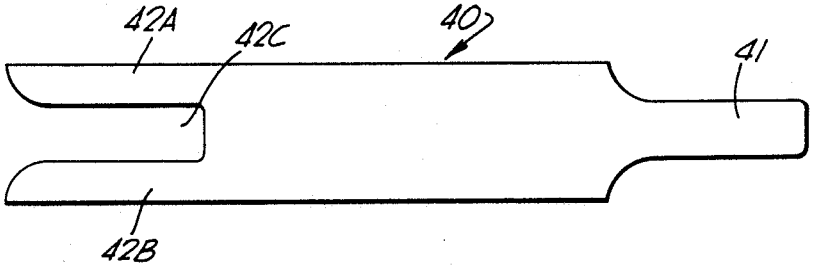

The flat blank 40 shown in FIG. 16 is made from strip steel of rectangular cross-section and of width 60 mm. At one end it has a tongue 41 and at the other end it has two spaced parallel arms 42A and 42B, the arrangement being such that the tongue 41 of one such blank fits in the space 42C between the two arms 42A and 42B of another such blank, so that many such blanks can be stamped from a very long strip of steel without there being much material wasted. Each of the blanks is then bent to form a clip-retainer 48 shaped as shown in FIG. 15, which shows an arch having a flat top 43, two rounded corners 44, a left-hand side constituted by the two arms 42A and 42B and a right-hand side 45 the lower end of which is constituted by the tongue 41, the extreme end 46 of which is bent to the right as shown. The left-hand side and the right-hand side of the arch diverge from each other and from a central vertical plane C as they proceed downwardly.

Figure 17:
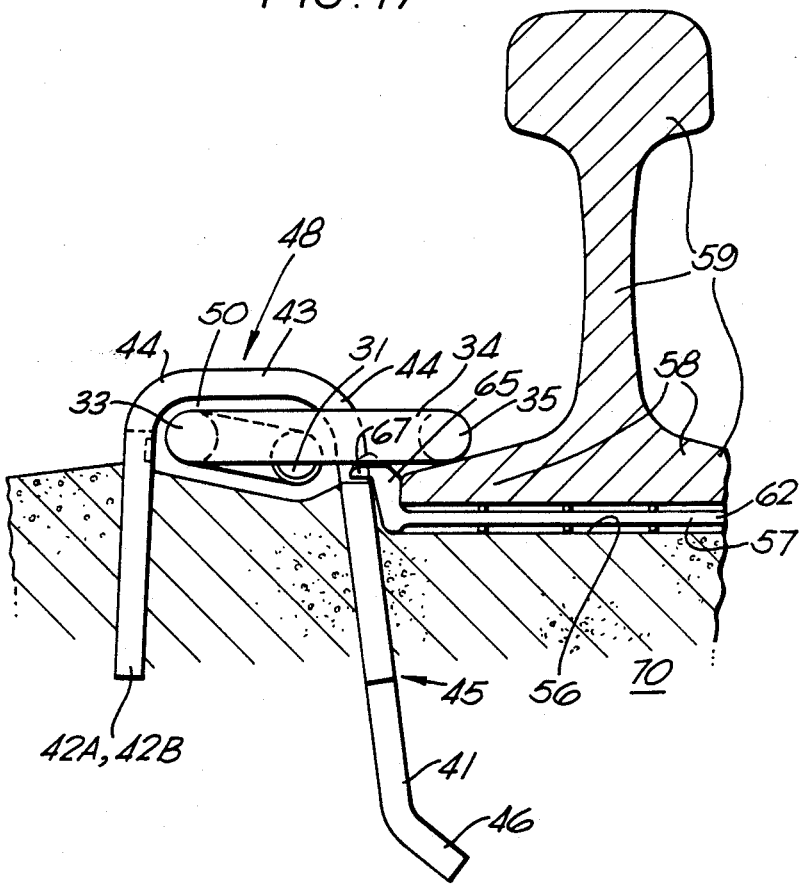
Figure 18:
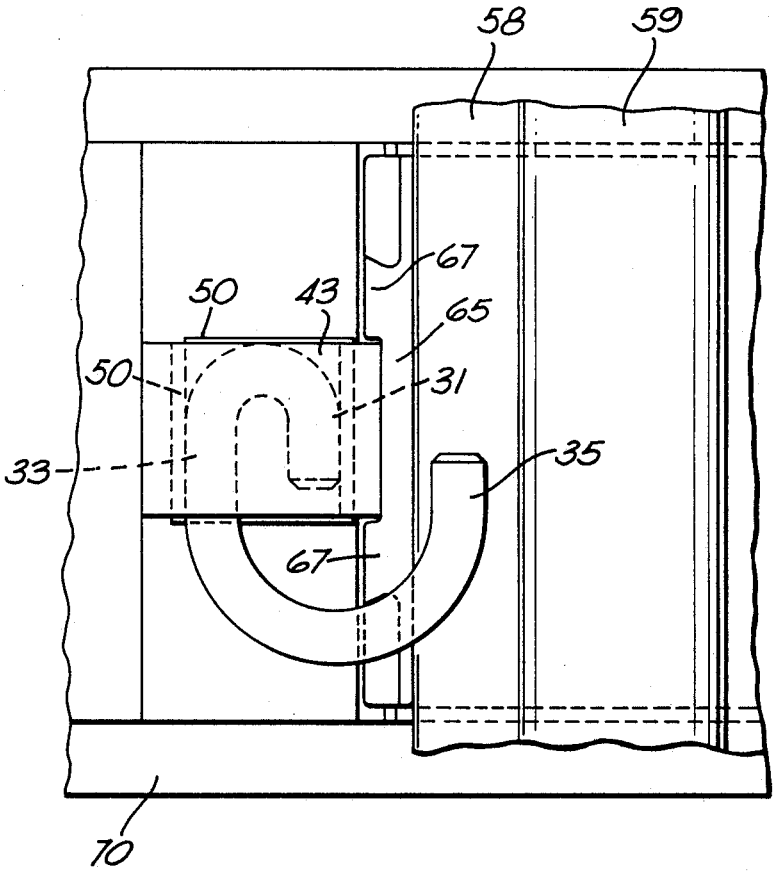
Figure 19:
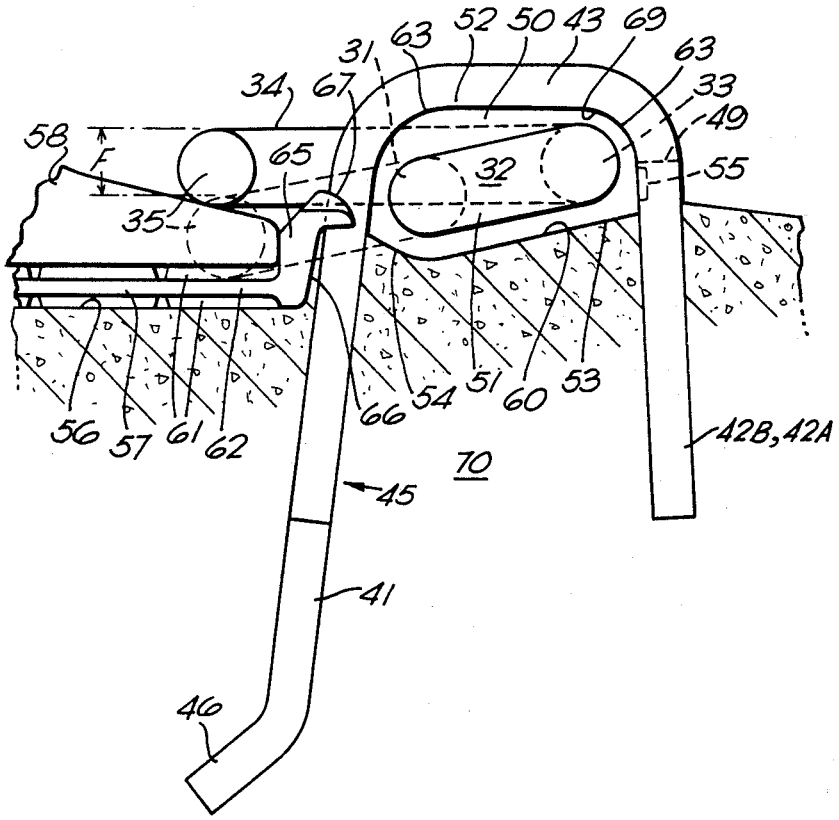
Figure 20:
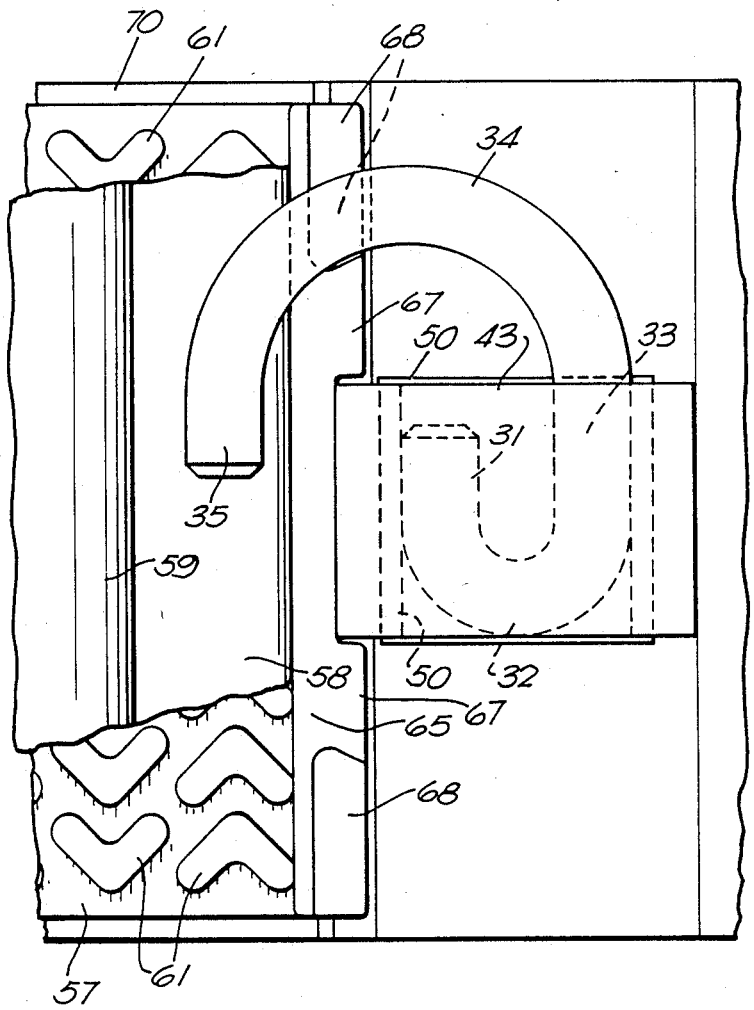

FIGS. 17 to 20 show a bushing 50 made from electrically insulating material, for example nylon reinforced with glass fibers, by injection molding. The bushing is about 65 mm. long (measured vertically in FIGS. 18 and 20) and is formed with an opening in the form of a through passageway 51 which has a cross-section corresponding in shape to that of an athletics racetrack, i.e. having two parallel straight sides and two semi-circular ends. The upper surface 52 of the bushing is flat and externally the bushing has on its lower side two flat surfaces 53 and 54 which are inclined to one another by an angle of about 135°. The bushing has at one side a projection 55 which lies between the arms 42A and 42B of the clip-retainer 48, just below the upper ends 49 of these arms, when the bushing is inserted into the upper part of the arch in the clip-retainer, as shown in FIGS. 17 and 19. Then the upper surface 52 of the bushing is in contact with the inside of the flat top 43 of the arch in the clip-retainer and rounded surfaces 63 of the bushing contact the insides of the rounded corners 44 of the arch.

Four such assemblies of steel clip-retainer 48 and insulating bushing 50 are suitably supported in a mold which is used to make concrete railway sleepers and the wet concrete mix is poured into the mold so that it sets around the parts of the clip-retainer 48 which are below the upper ends of the surfaces 53 and 54 of the bushing, which parts act as anchoring means for anchoring the clip-retainer 48 to the concrete. The bushings cause four recesses 60 to be formed in the top of the sleeper 70 and by other means two wider and deeper recesses 56 are formed in the top of the sleeper, each of which receives a pad 57 of electrically insulating material on which stands the flange 58 of a flange-footed railway rail 59.

When the railway sleeper is horizontal, the upper surface 52 of the bushing 50 is also horizontal but the straight sides of the cross-section of the passageway 51 through the bushing are inclined by about 12 or 13° to the horizontal.

Two identical clips according to FIGS. 11 to 13 are driven, in opposite directions parallel to the rail, by applying force to the free ends of their arms 31 or to their reverse bends 34, until in each case the arms 31 and 33 enter the passageway 51 through one of the bushings and the arms 35 press downwardly on opposite sides of the flange 58 of the rail. This causes the clips to become distorted so that the arm 35 of each of them is raised, in relation to its arms 31 and 33, by an amount F which is known as the "deflection" of the clip.

Each pad 57 is made by molding electrically insulating material, for example high-density polyethylene, and it has recesses in its two opposite major faces whereby there are formed in each of these faces several islands 61 of the pad material which are joined together by a central web 62 of the pad material, the islands being in the form of chevrons which are arranged in rows and in columns perpendicular to the rows, the chevrons on one face of the pad registering with those on the opposite face of the pad. Each pad has, extending along two opposite sides, upstanding portions 65 which prevent the rail moving to the left or to the right (considering FIG. 17). Each upstanding portion has an inclined face 66, remote from the rail, in contact with a side wall of the recess 56 in the sleeper and above that has two sideways-extending portions 67, one on each side of the clip-retainer 48. Each of the sideways-extending portions 67 is formed at each end with a recess 68, one or the other of which, according to the direction in which the clip is driven, receives the reverse bend 34 of the clip. The end wall of the recess 68 is abutted by the clip when the clip is driven into its position and prevents it from being driven too far.

It is believed that the deflection of the clip can be high without unacceptable danger of the clip breaking and the ratio between the force applied to the rail and the deflection of the clip is low. Consequently, it is believed that the force applied by the arm 35 of the clip to the rail flange is not altered much by the dimensions of the various parts of the assembly differing slightly from the desired values. The parts 31, 32 and 33 of the clip are immobilized by fitting tightly in the bushing and this is thought to contribute to the distribution of stresses in the remainder of the clip being more uniform than in the case of the clips according to FIGS. 1 and 2 and FIGS. 4 and 5, with the consequence that the clip will have an even longer useful life, being even less prone to breakage on account of metal fatigue.

The clip shown in FIGS. 17 and 18, for example, could be placed in a different orientation and then driven in the opposite direction (i.e. downwardly, considering FIG. 18) so that its arms 31 and 33 enter the bushing 50 and the arm 35 bears upon the rail flange. This is not possible with the clips shown in FIGS. 1 to 5. The clip shown in FIGS. 11 to 13 can form a neat stack with other such clips and thus can easily be used in the automatic machinery mentioned above. This is true also of a clip as shown in FIGS. 11 and 12 but with the modification according to FIG. 14.

The steel clip-retainer 48 only partially defines an opening 69 for the bushing 50, the opening being also partly defined by the concrete below the bushing, and the bushing can be extracted and replaced by another if necessary. If desired a cast steel clip-retainer could be used in place of the sheet steel clip-retainer 48, in which case it will alone define an opening for the bushing 50, which it will surround on all sides, considering FIG. 19.

The dimensions and materials mentioned above are only exemplary. Other dimensions and other suitable materials may be employed instead.

I claim:

1. A railway rail-fastener clip for fastening a railway rail to a foundation therefore, the clip having been made by bending an initially straight rod at least 8 mm thick approximately to the shape of a letter e having an upper arm, a center arm and a lower arm, the axes of all parts of the clips lying in a single plane when the clip is free from stress.

2. A clip according to claim 1 in which the rod when straight had a length less than 15 times the thickness of the rod.

3. A clip according to claim 1 in which the overlap between the center arm of the e and the lower arm of the e is less than the thickness of the rod.

4. A clip according to claim 1 in which the rod is chamfered around its entire periphery at both ends.

5. A railway rail-fastening clip for fastening a railway rail to a foundation therefore, the clip having been made by bending an initially straight rod approximately to the shape of a letter e having an upper arm, a center arm and a lower arm, the axes of all parts of the clip lying in a single plane, the clip having a first straight portion in the center arm of the e, a second straight portion in the upper arm of the e and a third straight portion in the lower arm of the e, these straight portions being parallel to one another and the shortest distance between the first and second straight portions being less than the shortest distance between the first and third straight portions.

6. An assembly comprising a foundation for a railway rail, a rail having at its base a flange standing on the foundation, a clip-retaining arrangement having an opening above the foundation beside the rail flange and a substantially e-shaped clip, comprising an upper arm, a center arm and a lower arm, having both the center arm and the upper arm of the e in said opening in the clip-retaining arrangement and substantially parallel to the rail, the lower arm of the e bearing downwardly on the upper surface of the rail flange.

7. An assembly according to claim 6 in which the clip-retaining arrangement includes a metallic part, which at least partially defines an opening, and a bushing of electrically insulating material in that opening, the clip having its center arm and its upper arm within the bushing.

8. An assembly according to claim 7 in which the bushing has a passageway through it, the cross-section of the passageway having substantially the form of a conventional athletic race track, with two parallel straight sides, which are inclined by a small angle to the horizontal, and two-semi-circular ends.

9. An assembly according to claim 7 in which the foundation is a concrete railway sleeper, the metallic part of the clip-retaining arrangement has anchoring means which has been incorporated in the sleeper during casting of the concrete and the sleeper has a recess in its upper surface, which recess has been formed by the presence of the bushing during the casting operation.

10. An assembly according to claim 9 wherein the sleeper is formed with a recess in which lies the flange of the rail, there being a pad of electrically insulating material between the bottom of the flange and the floor of the recess, the pad having at two opposite sides upstanding portions which prevent the rail moving sideways and at the tops of which there are sideways-extending portions on opposite sides of the metallic part of the clip-retaining arrangement.

11. A method of making a railway rail-and-fastening assembly comprising bending an initially straight rod approximately to the shape of a letter e having an upper arm, a center arm and a lower arm, the axes of all parts of the clip lying in a single plane, standing a rail, having a flange at its base, on a foundation from which projects a clip-retaining arrangement having an opening above the foundation beside the rail flange, and driving said clip so that both its center arm and its upper arm enter said opening and its lower arm bears downwardly on the rail flange.

12. A railway rail-fastening clip for fastening a railway clip to a foundation therefore, the clip having been made by bending an initially straight rod at least 8 mm thick approximately to the shape of a letter e having an upper arm, a center arm and a lower arm, the axes of all parts of the clip, except the free end of the lower arm of the e, lying in a single plane when the clip is free from stress.

13. A method of making a railway rail-and-fastening assembly comprising bending an initially straight rod approximately to the shape of a letter e having an upper arm, a center arm and a lower arm, the axes of all parts of the clip, except the free end of the lower arm, lying in a single plane, standing a rail, having a flange at its base, on a foundation from which projects a clip-retaining arrangement having an opening above the foundation beside the rail flange, and driving said clip so that both its center arm and its upper arm enter said opening and its lower arm bears downwardly on the rail flange.

* * * * *